US011581653B2

(12) United States Patent
Xu et al.

(10) Patent No.: US 11,581,653 B2
(45) Date of Patent: Feb. 14, 2023

(54) CURVED CONFORMAL FREQUENCY SELECTIVE SURFACE RADOME

(71) Applicant: Qufu Normal University, Shandong Province (CN)

(72) Inventors: Juan Xu, Shandong Province (CN); Min Zhao, Shandong Province (CN); Jianping Zhao, Shandong Province (CN); Jinzhao Guo, Shandong Province (CN); Siyu Wu, Shandong Province (CN); Yan Zhang, Shandong Province (CN); Tingting Shang, Shandong Province (CN)

(73) Assignee: Qufu Normal University, Shandong Province (CN)

( * ) Notice: Subject to any disclaimer, the term of this patent is extended or adjusted under 35 U.S.C. 154(b) by 0 days.

(21) Appl. No.: 17/472,510

(22) Filed: Sep. 10, 2021

(65) Prior Publication Data

US 2022/0149535 A1 May 12, 2022

(30) Foreign Application Priority Data

Nov. 9, 2020 (CN) ..... 202011241395.6

(51) Int. Cl.
*H01Q 15/00* (2006.01)
*H01Q 1/42* (2006.01)

(52) U.S. Cl.
CPC ..... *H01Q 15/0026* (2013.01); *H01Q 1/42* (2013.01)

(58) Field of Classification Search
CPC .. H01Q 1/42; H01Q 15/0013; H01Q 15/0026; H01Q 15/002
See application file for complete search history.

(56) References Cited

U.S. PATENT DOCUMENTS

| | | | | |
|---|---|---|---|---|
| 5,631,663 | A * | 5/1997 | David | H01Q 1/424 343/872 |
| 5,652,631 | A * | 7/1997 | Bullen | H01Q 1/425 343/753 |
| 10,347,962 | B1 * | 7/2019 | Georgakopoulos | H01Q 1/362 |
| 10,833,399 | B1 * | 11/2020 | Howarth | H01Q 9/36 |
| 10,840,593 | B1 * | 11/2020 | Johnson | H01Q 5/25 |
| 10,938,105 | B2 * | 3/2021 | Snyder | H01Q 19/193 |

(Continued)

FOREIGN PATENT DOCUMENTS

CN 106654569 * 5/2017

*Primary Examiner* — Awat M Salih
(74) *Attorney, Agent, or Firm* — Bekiares Eliezer LLP

(57) ABSTRACT

The present disclosure relates to a curved conformal frequency selective surface (FSS) radome. The radome includes a dielectric radome and a curved conformal FSS array arranged on an outer wall of the dielectric radome, where the dielectric radome includes a dome, a circular truncated cone and a hollow cylinder which are integrally formed from top to bottom, and the curved conformal FSS array is formed by periodically arraying foldable FSS units on an outer surface of the dielectric radome, the foldable FSS unit being of an axially symmetrical and centrally symmetrical gap structure, and having an overall shape consisting of foldable gaps on a left side, an upper side, a right side and a lower side, the four foldable gaps being sequentially connected in a square shape, and remaining parts of the foldable FSS unit except for the four foldable gaps being all metal patches.

10 Claims, 6 Drawing Sheets

(56) References Cited

U.S. PATENT DOCUMENTS

| | | | | |
|---|---|---|---|---|
| 11,264,728 | B1 * | 3/2022 | Bringuier | H01Q 19/192 |
| 2014/0354479 | A1 * | 12/2014 | Britz | H01Q 15/0086 342/372 |
| 2015/0084835 | A1 * | 3/2015 | Snyder | H01Q 15/0013 343/909 |

* cited by examiner

CURVED CONFORMAL FREQUENCY SELECTIVE SURFACE RADOME

CROSS REFERENCE TO RELATED APPLICATION

This patent application claims the benefit and priority of Chinese Patent Application No. 202011241395.6 filed on Nov. 9, 2020, the disclosure of which is incorporated by reference herein in its entirety as part of the present application.

TECHNICAL FIELD

The present disclosure relates to the technical field of microwave frequency selective surface (FSS) radome, and in particular to a curved conformal FSS radome.

BACKGROUND

In the era of electronic warfare, it is extremely essential to protect antenna devices from the interference and damage of harsh natural environments and complex electromagnetic environments. Accordingly, it is of profound and lasting significance to design microwave/millimeter wave passive devices to improve the stability and sensitivity of an antenna system and prolong the working life. As a spatial filter, the FSS radome (E. Pelton and B. Munk, "A streamlined metallic radome," in IEEE Transactions on Antennas and Propagation, vol. 22, no. 6, pp. 799-803, November 1974, doi: 10.1109/TAP.1974.1140896) plays a key role in the field of modern military, can be used for improving the in-band passability and out-of-band rejection of the system, and is developing towards the higher frequency band and integration. Traditional FSS radomes mostly work in X/K/Ku and other lower frequency bands, and have large size, and FSSs mostly appear in the form of plane arrays (G. Q. Luo et al., "Filtenna Consisting of Horn Antenna and Substrate Integrated Waveguide Cavity FSS," in IEEE Transactions on Antennas and Propagation, vol. 55, no. 1, pp. 92-98, January 2007, doi: 10.1109/TAP.2006.888459), which cannot satisfy the requirements for miniaturization and integration of radomes in the field of contemporary national defense and aerospace. Accordingly, it is particularly essential to design an FSS radome, which works in a millimeter wave and has a conformal curved surface.

SUMMARY

An object of the present disclosure is to provide a conical curved conformal FSS radome. The FSS radome may reduce the influence of a complex external electromagnetic environment on a radome system while not influencing radiation performance of a feed antenna inside the radome.

The technical solution to achieve the object of the present disclosure is as follows: the curved conformal FSS radome includes a dielectric radome and a curved conformal FSS array arranged on an outer wall of the dielectric radome;

the dielectric radome includes a dome, a circular truncated cone and a hollow cylinder which are integrally formed from top to bottom, an inner side and an outer side of the dome being spherized, the inner side being in a shape of a hemisphere, and the outer side being circular arc parts on two sides and a flat top part reserved after a sphere top of the hemisphere is cut off; a top-removed circular cone structure with a radius progressively increased from top to bottom being used for the circular truncated cone, and a thickness from an inner wall to an outer wall of the circular truncated cone being equal; and a radius of an inner wall of the hollow cylinder being equal to a radius of an inner wall at the bottom of the circular truncated cone, and a radius of an outer side of the hollow cylinder being equal to a radius of an outer wall at the bottom of the circular truncated cone; and the curved conformal FSS array is formed by periodically arraying foldable FSS units on an outer surface of the dielectric radome, the foldable FSS unit being of an axially symmetrical and centrally symmetrical gap structure, and having an overall shape consisting of a left foldable gap, an upper foldable gap, a right foldable gap and a lower foldable gap, the four foldable gaps being completely the same and being sequentially connected in a square shape, and remaining parts of the foldable FSS unit except for the four foldable gaps being all metal patches.

Further, the left foldable gap in the foldable FSS unit is folded specifically in a manner of bending rightwards from a first edge in a vertical direction to a second edge, then bending downwards to a third edge, bending leftwards to a fourth edge, bending downwards to a fifth edge, then bending rightwards to a sixth edge, bending downwards to a seventh edge, then bending leftwards to an eighth edge, and finally bending downwards to a ninth edge, where a size of the first edge is the same as that of the ninth edge, and has a numerical value being k times of 0.1925 mm; a size of the second edge is the same as that of the fourth edge, the sixth edge and the eighth edge, and has a numerical value being k times of 0.131 mm; a size of the third edge is the same as that of the fifth edge and the seventh edge, and has a numerical value being k times of 0.077 mm, and k is a positive integer; and folding manners and structural sizes of the upper foldable gap, the right foldable gap and the lower foldable gap are the same as those of the left foldable gap, and the four foldable gaps satisfy a structural relation of axial symmetry and central symmetry.

Further, an angle of inclination and a length of a bus of the dielectric radome are calculated according to a height of the circular truncated cone and a radius of the hollow cylinder, and the number of layers of the foldable FSS units placed on the outer surface of the dielectric radome is further calculated according to a side length of the foldable FSS unit.

Further, for each layer of foldable FSS units, a radius of a circle of an outer surface of the dielectric radome where a center of the foldable FSS unit is located is calculated to obtain a circumference of the circle of the circle of the outer surface of the dielectric radome where the layer of foldable FSS units are located, and the number of the foldable FSS units placed on the layer is further calculated according to the side length of the foldable FSS unit again; and the foldable FSS unit is arranged on the layer at an equally-spaced angle in a round-down manner in a case where the circumference of the circle may be indivisible by the side length of the foldable FSS unit.

Further, intervals of the foldable FSS units are varied from one layer to the other, and parameters satisfy the following relations:

$$ls = \text{floor}\left(\frac{l}{le}\right)$$

$$rf_1 = r_{13} - \frac{h/1.25}{\tan\theta}$$

$$rf_i = rf_{i-1} + le \times \cos(\theta)$$

-continued $$num_i = \text{floor}\left(\frac{2 \times \pi \times rf_i}{le}\right)$$

in equations, ls is the number of layers of the units that may be arranged on the bus, floor( ) is a rounding function, l is the length of the bus, le is the side length of the foldable FSS unit, $rf_1$ is a radius of an outer surface of the dielectric radome where a first layer of foldable FSS units are located from top to bottom, $r_{13}$ is a radius of an inner side of the hollow cylinder of the dielectric radome, h is the height of the circular truncated cone of the dielectric radome, θ is an included angle between an extension line of the bus and a bottom plane of the hollow cylinder, $rf_i$ is a radius of an outer surface of the dielectric radome where an i-th layer of foldable FSS units are located, $rf_{i-1}$ is a radius of an outer surface of the dielectric radome where an (i−1)-th layer of foldable FSS units are located, and $num_i$ is the number of the i-th layer of foldable FSS units arranged along the outer surface of the dielectric radome.

Further, the curved conformal FSS array has 10 layers, including a first layer, a second layer, a third layer, a fourth layer, a fifth layer, a sixth layer, a seventh layer, an eighth layer, a ninth layer and a tenth layer from top to bottom respectively, where 7 units are placed on the first layer with adjacent units being spaced at a central angle of 51.42°, 9 units are placed on the second layer with adjacent units being spaced at a central angle of 40°, 10 units are placed on the third layer with adjacent units being spaced at a central angle of 36°, 12 units are placed on the fourth layer with adjacent units being spaced at a central angle of 30°, 14 units are placed on the fifth layer with adjacent units being spaced at a central angle of 25.71°, 16 units are placed on the sixth layer with adjacent units being spaced at a central angle of 22.5°, 18 units are placed on the seventh layer with adjacent units being spaced at a central angle of 20°, 20 units are placed on the eighth layer with adjacent units being spaced at a central angle of 18°, 21 units are placed on the ninth layer with adjacent units being spaced at a central angle of 17.14°, and 23 units are placed on the tenth layer with adjacent units being spaced at a central angle of 15.65°.

Compared with the prior art, the present disclosure has the remarkable advantages: (1) the millimeter wave bandpass FSS radome may reduce interference of the external complex electromagnetic environment on the radome system without influencing a parameter S and radiation performance of the feed antenna inside the radome; (2) in a case of harsh natural environments of rain, snow, wind, frost, etc., the FSS radome may achieve a function of physical protection, thereby prolonging service life of the system; and (3) the FSS radome may modify the size of the FSS unit with a conformal surface to achieve band-pass filtering of other frequency bands, so it has better popularization and extensive applications.

DETAILED DESCRIPTION OF THE EMBODIMENTS

The present disclosure provides a curved conformal FSS radome, which operates in a millimeter wave, and a model as a whole consists of a dielectric radome and a curved conformal FSS array, where a main body of the dielectric radome is a cone, a top of a radome body is smoothed, an inner side of the radome body is in a shape of a hemisphere, and an outer side of the radome body is circular arc parts on two sides reserved after a sphere top of the hemisphere is cut off after hemispherical treatment; and a bottom of the radome body is a hollow cylinder with a certain thickness, a thickness thereof is kept consistent with a wall thickness of a circular truncated cone, and finally, the top, a cone body and the bottom are connected to form the complete dielectric radome. In addition, the curved conformal FSS array is formed by arraying foldable bandpass FSS units on an outer surface of the circular truncated cone. Firstly, the number of the units that may be arranged on a bus of the radome is calculated, thereby determining the number of layers of the units that need to be conformal, and the FSS unit is copied in a direction of the bus. For each layer of FSS units, a radius and circumference of an outer side of the circular truncated cone where a center of each layer of FSS units is located are calculated, the number of the units that may be placed on this layer is calculated, and the FSS unit is rotationally copied with a Z axis as a center. Finally, the arranged FSS units are conformal to an outer surface of the radome by means of projection operation to form the curved conformal FSS array.

Figure 1A:
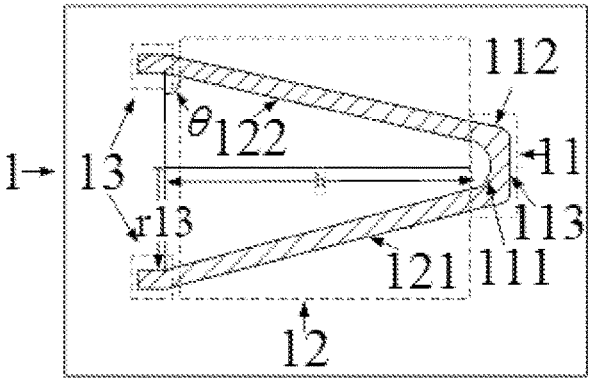
FIGS. 1(*a*) and 1(*b*) are structural diagrams of a curved conformal FSS radome of the present disclosure, where 1(*a*) is a cutaway view, and 1(*b*) is a top view.
Figure 1B:
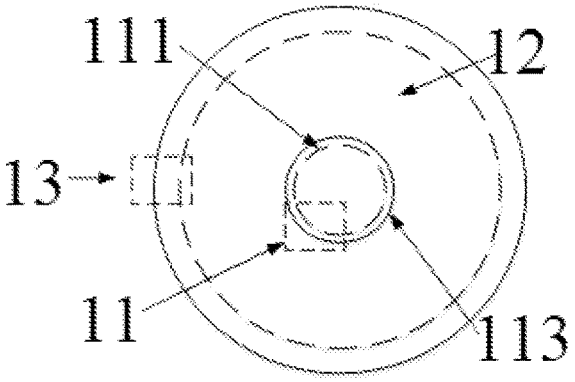

With reference to FIGS. 1(*a*) and 1(*b*), the curved conformal FSS radome of the present disclosure includes the dielectric radome 1 and the curved conformal FSS array 2 arranged on an outer wall of the dielectric radome.

The dielectric radome 1 includes a dome 11, the circular truncated cone 12 and a hollow cylinder 13 which are integrally formed from top to bottom. An inner side and an outer side of the dome 11 are spherized, the inner side is in a shape of a hemisphere 111, and the outer side is circular arc parts 112 on two sides and a flat top part 113 reserved after a sphere top of the hemisphere is cut off. A top-removed circular cone structure with a radius progressively increased from top to bottom may be adopted for the circular truncated cone 12, and a thickness from an inner wall 122 to an outer wall 121 of the circular truncated cone 12 is equal. The radius of an inner wall of the hollow cylinder 13 is equal to that of an inner wall at the bottom of the circular truncated cone 12, and the radius of an outer side of the hollow cylinder is equal to that of an outer wall at the bottom of the circular truncated cone 12.

The curved conformal FSS array 2 is formed by periodically arraying the foldable FSS units 21 on an outer surface of the dielectric radome 1. The foldable FSS unit 21 is of an axially symmetrical and centrally symmetrical gap structure, and has an overall shape consisting of a left foldable gap 211, an upper foldable gap 213, a right foldable gap 212 and a lower foldable gap 214, the four foldable gaps are completely the same and sequentially connected in a square shape, and remaining parts of the foldable FSS unit 21 except for the four foldable gaps are all metal patches 215.

Figure 2A:
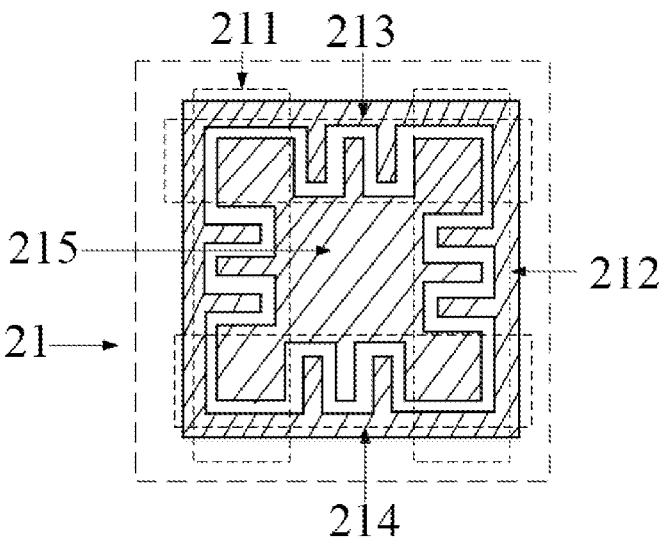
FIGS. 2(*a*) and 2(*b*) are structural diagrams of a foldable FSS unit in the present disclosure, where 2(*a*) is a front view, and 2(*b*) is a schematic diagram of a gap structure.
Figure 2B:
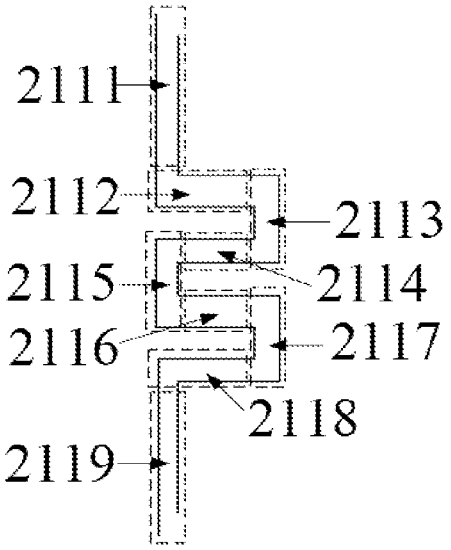

With reference to FIGS. 2(*a*) and 2(*b*), the left foldable gap 211 in the foldable FSS unit 21 is folded specifically in a manner of bending rightwards from a first edge 2111 in a vertical direction to a second edge 2112, then bending downwards to a third edge 2113, bending leftwards to a fourth edge 2114, bending downwards to a fifth edge 2115, then bending rightwards to a sixth edge 2116, bending downwards to a seventh edge 2117, then bending leftwards to an eighth edge 2118, and finally bending downwards to a ninth edge 2119. The size of the first edge 2111 is the same as that of the ninth edge 2119 and has a numerical value being k times of 0.1925 mm, the size of the second edge 2112 is the same as that of the fourth edge 2114, the sixth edge 2116 and the eighth edge 2118 and has a numerical value being k times of 0.131 mm, the size of the third edge 2113 is the same as that of the fifth edge 2115 and the seventh edge 2117 and has a numerical value being k times of 0.077 mm, and k is a positive integer; and folding manners and structural sizes of the upper foldable gap 213, the right foldable gap 212 and the lower foldable gap 214 are the same as those of the left foldable gap 211, and the four foldable gaps satisfy a structural relation of axial symmetry and central symmetry.

Further, an angle of inclination and a length of the bus of the dielectric radome 1 are calculated according to a height of the circular truncated cone 12 and a radius of the hollow cylinder 13, and the number of layers of the foldable FSS units 21 placed on the outer surface of the dielectric radome 1 is further calculated according to a side length of the foldable FSS unit 21.

Further, for each layer of foldable FSS units 21, a radius of a circle of an outer surface of the dielectric radome 1 where a center of the foldable FSS unit 21 is located is calculated to obtain a circumference of the circle of the outer surface of the dielectric radome 1 where the layer of foldable FSS units 21 are located, and the number of the foldable FSS units 21 placed on the layer is further calculated according to the side length of the foldable FSS unit 21 again; and the foldable FSS units 21 are arranged on the layer at an equally-spaced angle in a round-down manner in a case where the circumference of the circle may be indivisible by the side length of the foldable FSS unit 21.

Further, intervals of the foldable FSS units 21 are varied from one layer to the other, and parameters satisfy the following relations:

$$ls = \text{floor}\left(\frac{l}{le}\right)$$

$$rf_1 = r_{13} - \frac{h/1.25}{\tan\theta}$$

$$rf_i = rf_{i-1} + le \times \cos(\theta)$$

$$num_i = \text{floor}\left(\frac{2 \times \pi \times rf_i}{le}\right)$$

in equations, ls is the number of layers of the units that may be arranged on the bus, floor( ) is a rounding function, l is the length of the bus, le is the side length of the foldable FSS unit 21, $rf_1$ is a radius of an outer surface of the dielectric radome 1 where a first layer of foldable FSS units 21 are located from top to bottom, $r_{13}$ is a radius of an inner side of the hollow cylinder 13 of the dielectric radome 1, h is the height of the circular truncated cone 12 of the dielectric radome 1, θ is an included angle between an extension line of the bus and a bottom plane of the hollow cylinder 13, $rf_i$ is a radius of an outer surface of the dielectric radome 1 where an i-th layer of foldable FSS units (21) are located, $rf_{i-1}$ is a radius of an outer surface of the dielectric radome 1 where an (i−1)-th layer of foldable FSS units 21 are located, and $num_i$ is the number of the i-th layer of foldable FSS units 21 arranged along the outer surface of the dielectric radome 1.

Figure 3:
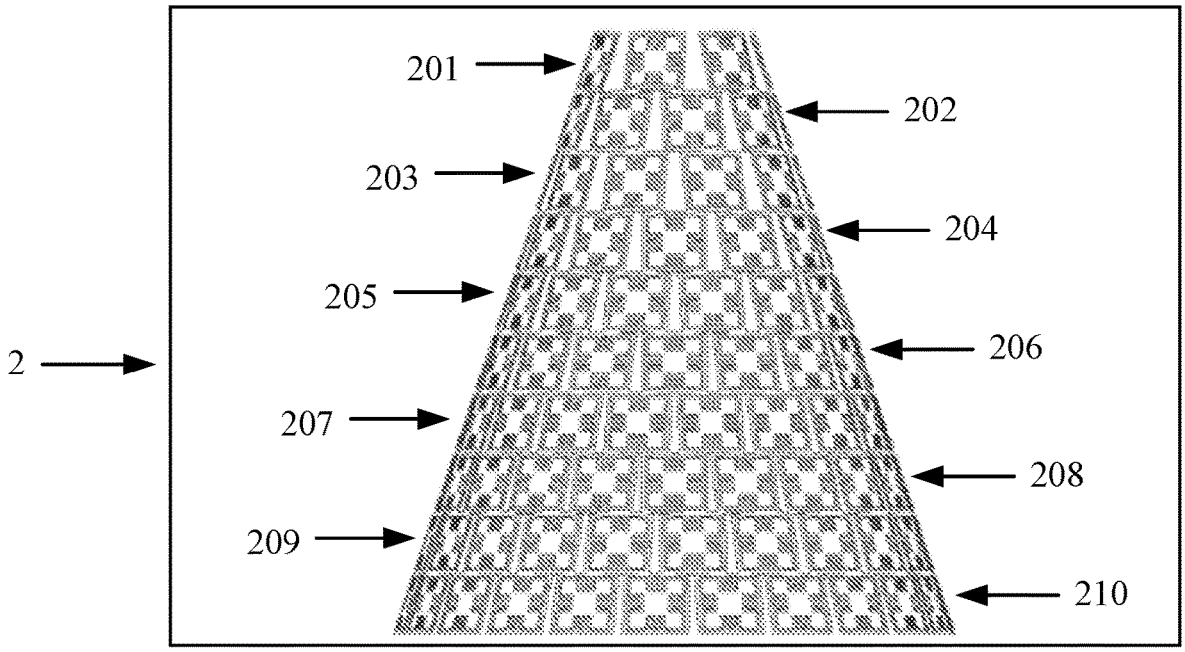
FIG. 3 is a schematic diagram of a curved conformal FSS array in the present disclosure.

With reference to FIG. 3, the curved conformal FSS array 2 has 10 layers, including a first layer 201, a second layer 202, a third layer 203, a fourth layer 204, a fifth layer 205, a sixth layer 206, a seventh layer 207, an eighth layer 208, a ninth layer 209 and a tenth layer 210 from top to bottom respectively. Among them, 7 units are placed on the first layer 201 with adjacent units being spaced at a central angle of 51.42°, 9 units are placed on the second layer 202 with adjacent units being spaced at a central angle of 40°, 10 units are placed on the third layer 203 with adjacent units being spaced at a central angle of 36°, 12 units are placed on the fourth layer 204 with adjacent units being spaced at a central angle of 30°, 14 units are placed on the fifth layer 205 with adjacent units being spaced at a central angle of 25.71°, 16 units are placed on the sixth layer 206 with adjacent units being spaced at a central angle of 22.5°, 18 units are placed on the seventh layer 207 with adjacent units being spaced at a central angle of 20°, 20 units are placed on the eighth layer 208 with adjacent units being spaced at a central angle of 18°, 21 units are placed on the ninth layer 209 with adjacent units being spaced at a central angle of 17.14°, and 23 units are placed on the tenth layer 210 with adjacent units being spaced at a central angle of 15.65°.

The curved conformal FSS radome of the present disclosure has the advantages of protecting a feed antenna from interference of an external harsh natural environment and an electromagnetic environment, and may achieve excellent in-band passability and out-of-band rejection.

The present disclosure will be further described below in conjunction with the drawings and particular embodiments.

Embodiment

Compared with a traditional dielectric radome, a conical curved conformal FSS radome of the present disclosure has better filtering characteristics and has a more flexible and adjustable working frequency band. In an attempt to better reduce interference of an external electromagnetic environment to a feed antenna, a foldable FSS is conformal on an outer surface of the radome, which not only does not influence radiation performance of the feed antenna inside the radome, but also improves in-band passability and out-of-band rejection of a radome system.

With reference to FIGS. 1(*a*) and 1(*b*), the conical curved conformal FSS radome of the present disclosure includes a dielectric radome and a curved conformal FSS array which are arranged from inside to outside.

An upper part of the dielectric radome is a dome subjected to smoothing, a middle part of the dielectric radome is a circular truncated cone with a certain wall thickness, and a lower part of the dielectric radome is a hollow cylinder with the same wall thickness as the middle part. An inner side and an outer side of the dome are spherized, where the inner side is in a shape of a hemisphere, and the outer side is circular arc parts on two sides and a flat top part reserved after a sphere top of the hemisphere is cut off. The circular truncated cone is obtained by cutting an internal circular truncated cone from an external circular truncated cone with the same height and different radiuses, the radius of a top of the circular truncated cone is different from that of a bottom of the circular truncated cone, the radius of the bottom of the circular truncated cone is greater than that of the top of the circular truncated cone, and an overall thickness of the circular truncated cone is kept consistent from top to bottom. The radius of an inner side of the hollow cylinder is equal to that of an inner side at the bottom of the circular truncated cone, and the radius of an outer side of the hollow cylinder is equal to that of an outer side of the circular truncated cone.

With reference to FIGS. 2(*a*) and 2(*b*), the curved conformal FSS array is formed by periodically arraying foldable FSS units on an outer surface of the dielectric radome. The foldable FSS unit is an axially symmetric and centrally symmetrical gap structure, and has an overall shape consisting of a left foldable gap, an upper foldable gap, a right foldable gap and a lower foldable gap, widths and lengths of the four foldable gaps are kept consistent, and remaining parts of the foldable FSS unit except for the four foldable gaps are all metal patches. The foldable FSS unit is arrayed on the outer surface of the dielectric radome according to the principle of periodic arrangement, the number of the units that may be arranged on a length of a bus, that is, the number of layers of the units that may be placed on the dielectric radome, is calculated according to an angle of inclination of the bus of the radome and a side length of the foldable FSS unit. For each layer of FSS units, a circumference of a circle of an outer surface of the radome where each layer of FSS units are located is calculated, the number of the FSS units that may be placed on this layer is calculated according to the side length of the foldable FSS unit. Particularly, the number of the units is rounded down to arrange the FSS units at equally-spaced angles on this layer for a case where the circumference of the circle is indivisible by the side length of the foldable FSS unit. It should be noted that intervals of the FSS units on different layers are different from one another, which may be explained by the following equations:

$$ls = \text{floor}\left(\frac{l}{le}\right)$$

$$rf_1 = r_{13} - \frac{h/1.25}{\tan\theta}$$

$$rf_i = rf_{i-1} + le \times \cos(\theta)$$

$$num_i = \text{floor}\left(\frac{2 \times \pi \times rf_i}{le}\right),$$

where in equations, ls is the number of layers of the units that may be arranged on the bus, floor( ) is a rounding function, l is the length of the bus, le is the side length of the foldable FSS unit, $rf_1$ is a radius of an outer surface of the dielectric radome where a first layer of foldable FSS units are located from top to bottom, $r_{13}$ is a radius of an inner side of the hollow cylinder of the dielectric radome, h is a height of the circular truncated cone of the dielectric radome, θ is an included angle between an extension line of the bus and a bottom plane of the hollow cylinder, $rf_i$ is a radius of an outer surface of the dielectric radome where an i-th layer of foldable FSS units are located, $rf_{i-1}$ is a radius of an outer surface of the dielectric radome where an (i−1)-th layer of foldable FSS units are located, and $num_i$ is the number of the i-th layer of foldable FSS units arranged along the outer surface of the dielectric radome.

With reference to FIG. 3, the curved conformal FSS array has 10 layers, including a first layer, a second layer, a third layer, a fourth layer, a fifth layer, a sixth layer, a seventh layer, an eighth layer, a ninth layer and a tenth layer from top to bottom respectively. Among them, 7 units are placed on the first layer with adjacent units being spaced at a central angle of 51.42°, 9 units are placed on the second layer with adjacent units being spaced at a central angle of 40°, 10 units are placed on the third layer with adjacent units being spaced at a central angle of 36°, 12 units are placed on the fourth layer with adjacent units being spaced at a central angle of 30°, 14 units are placed on the fifth layer with adjacent units being spaced at a central angle of 25.71°, 16 units are placed on the sixth layer with adjacent units being spaced at a central angle of 22.5°, 18 units are placed on the seventh layer with adjacent units being spaced at a central angle of 20°, 20 units are placed on the eighth layer with adjacent units being spaced at a central angle of 18°, 21 units are placed on the ninth layer with adjacent units being spaced at a central angle of 17.14°, and 23 units are placed on the tenth layer with adjacent units being spaced at a central angle of 15.65°.

A parameter design process of the conical curved conformal FSS radome of the present disclosure includes:

(I) a thickness range, a height range and a dielectric constant range of the circular truncated cone 12 of the dielectric radome are 0.32 mm, 6.41 mm and 1.08 respectively, a radius range of an inner side of a top of the circular truncated cone is 0.625 mm, and a radius range of the inner side of the bottom of the circular truncated cone is 2.58 mm;

(II) a thickness range, a height range, a radius range of the inner side and a dielectric constant range of the hollow cylindrical 13 at a bottom of the dielectric radome are 0.32 mm, 0.565 mm, 2.58 mm and 1.08 respectively;

(III) a periodic size range and a gap width range of the foldable FSS unit 21 are 0.52 mm and 0.026 mm respectively;

(IV) a length range, a width range, a thickness range, and a dielectric constant range of a dielectric substrate of a four-unit microstrip patch antenna are 6.37 mm, 5.57 mm, 0.171 mm and 2.2 respectively, and a length range and a width range of a ground plate are 6.37 mm and 5.57 mm respectively; and (V) a length range and a width range of the rectangular patch are 0.935 mm and 0.535 mm respectively.

Figure 4:
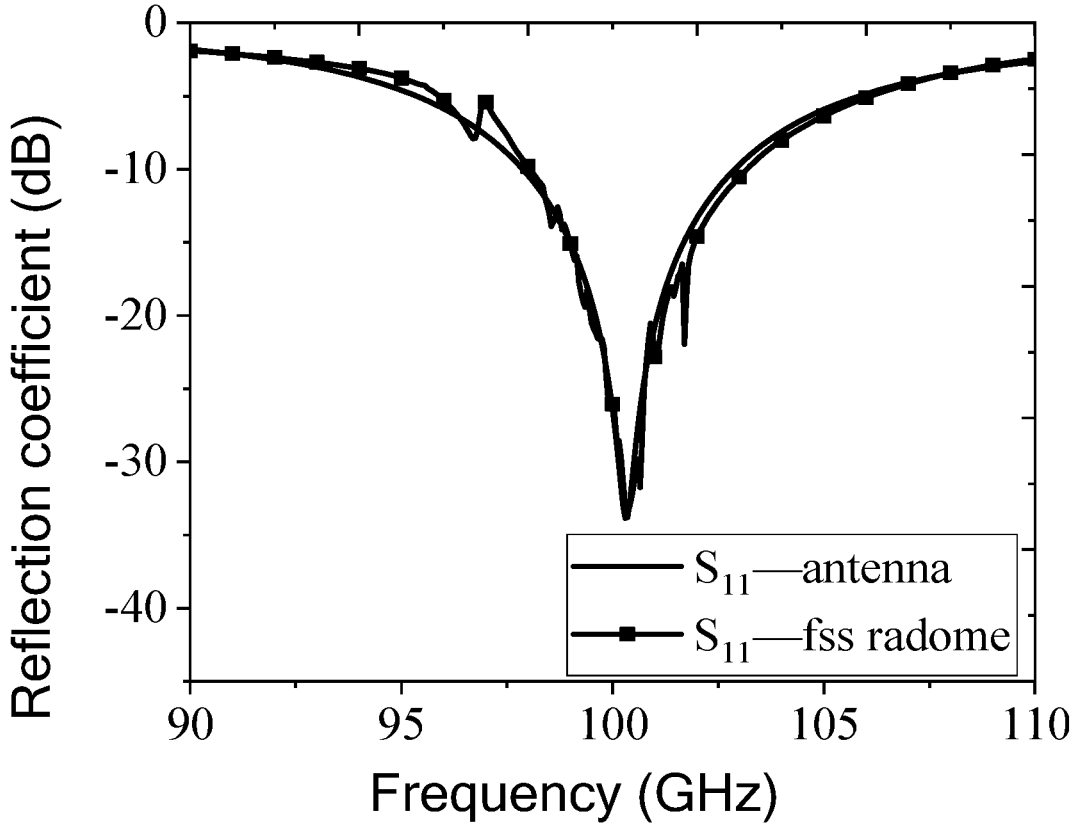
FIG. 4 is a comparison diagram of a parameter S11 before and after loading the FSS radome.
Figure 5A:
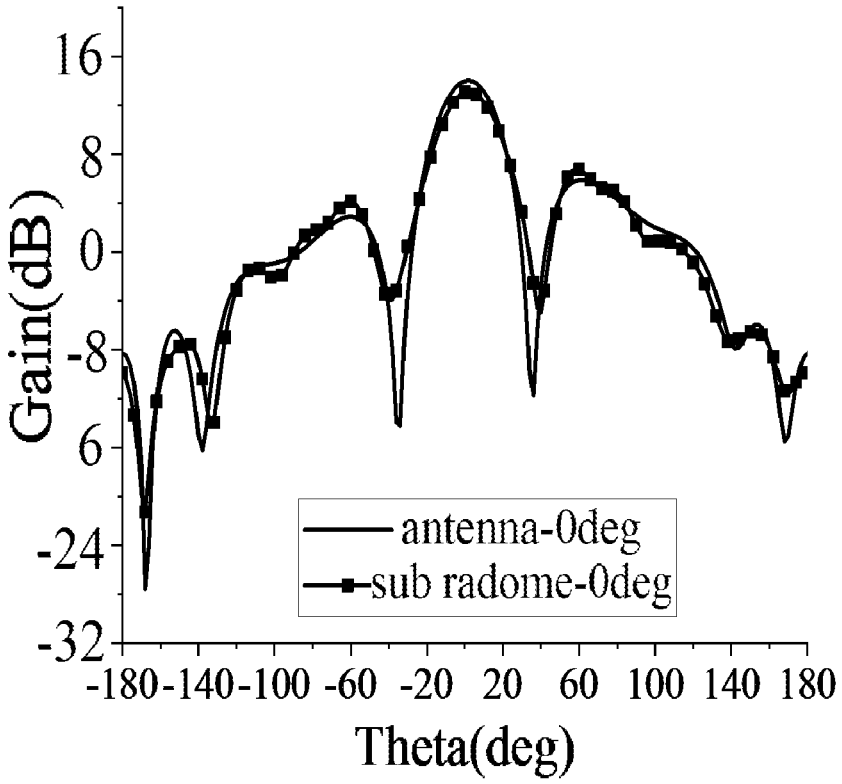
FIGS. 5(*a*) and 5(*b*) are comparison diagrams of radiation performance before and after loading the FSS radome, where 5(*a*) is a pattern of plane E, and 5(*b*) is a pattern of plane H.
Figure 5B:
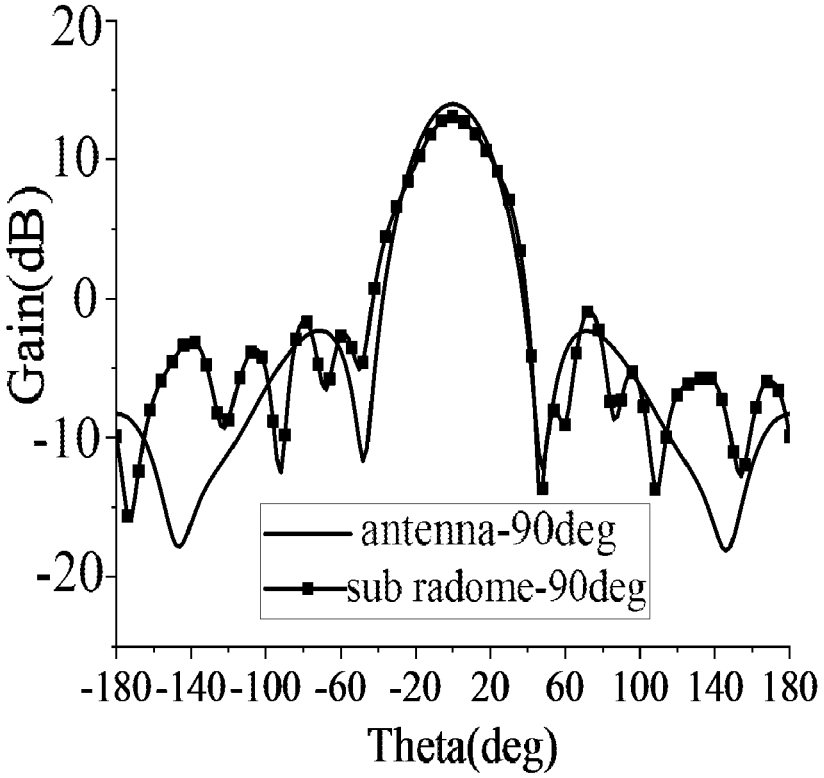

The four-unit microstrip patch antenna is placed at an axial position below the curved conformal FSS radome. Full-wave simulation is conducted on the radome system. FIG. 4 shows a comparison diagram of a parameter $S_{11}$ before and after loading the curved conformal FSS radome. FIGS. 5(*a*) and 5(*b*) show patterns of planes E and H before and after loading the curved conformal FSS radome. It is found that loading the curved conformal FSS radome has less influence on the parameter S and radiation characteristics of the feed antenna, may also improve the out-of-band rejection, and reduces the influence of external natural and electromagnetic environments on the feed antenna.

What is claimed is:

1. A curved conformal frequency selective surface (FSS) radome, comprising:

a dielectric radome (1) and a curved conformal FSS array (2) arranged on an outer wall of the dielectric radome;

the dielectric radome (1) comprises a dome (11), a circular truncated cone (12) and a hollow cylinder (13) which are integrally formed from top to bottom, an inner side and an outer side of the dome (11) being spherized, the inner side being in a shape of a hemisphere (111), and the outer side being circular arc parts (112) on two sides and a flat top part (113) reserved after a sphere top of the hemisphere is cut off; a top-removed circular cone structure with a radius progressively increased from top to bottom being used for the circular truncated cone (12), and a thickness from an inner wall (122) to an outer wall (121) of the circular truncated cone (12) being equal; and a radius of an inner wall of the hollow cylinder (13) being equal to a radius of an inner wall at the bottom of the circular truncated cone (12), and a radius of an outer side of the hollow cylinder (13) being equal to a radius of an outer wall at the bottom of the circular truncated cone (12); and the curved conformal FSS array (2) is formed by periodically arraying foldable FSS units (21) on an outer surface of the dielectric radome (1), the foldable FSS unit (21) being of an axially symmetrical and centrally symmetrical gap structure, and having an overall shape consisting of a left foldable gap (211), an upper foldable gap (213), a right foldable gap (212) and a lower foldable gap (214), the four foldable gaps being completely the same and being sequentially connected in a square shape, and remaining parts of the foldable FSS unit (21) except for the four foldable gaps being all metal patches (215).

2. The curved conformal FSS radome according to claim 1, wherein the left foldable gap (211) in the foldable FSS unit (21) is folded specifically in a manner of bending rightwards from a first edge (2111) in a vertical direction to a second edge (2112), then bending downwards to a third edge (2113), bending leftwards to a fourth edge (2114), bending downwards to a fifth edge (2115), then bending rightwards to a sixth edge (2116), bending downwards to a seventh edge (2117), then bending leftwards to an eighth edge (2118), and finally bending downwards to a ninth edge (2119), a size of the first edge (2111) being the same as that of the ninth edge (2119), and having a numerical value being k times of 0.1925 mm; a size of the second edge (2112) being the same as that of the fourth edge (2114), the sixth edge (2116) and the eighth edge (2118), and having a numerical value being k times of 0.131 mm; a size of the third edge (2113) being the same as that of the fifth edge (2115) and the seventh edge (2117), and having a numerical value being k times of 0.077 mm, and k being a positive integer; and folding manners and structural sizes of the upper foldable gap (213), the right foldable gap (212) and the lower foldable gap (214) being the same as those of the left foldable gap (211), and the four foldable gaps satisfying a structural relation of axial symmetry and central symmetry.

3. The curved conformal FSS radome according to claim 2, wherein an angle of inclination and a length of a bus of the dielectric radome (1) are calculated according to a height of the circular truncated cone (12) and a radius of the hollow cylinder (13), and the number of layers of the foldable FSS units (21) placed on the outer surface of the dielectric radome (1) is further calculated according to a side length of the foldable FSS unit (21).

4. The curved conformal FSS radome according to claim 3, wherein for each layer of foldable FSS units (21), a radius of a circle of an outer surface of the dielectric radome (1) where a center of the foldable FSS unit (21) is located is calculated, to obtain a circumference of the circle of the outer surface of the dielectric radome (1) where the layer of foldable FSS units (21) are located, and the number of the foldable FSS units (21) placed on the layer is further calculated according to the side length of the foldable FSS unit (21) again; and the foldable FSS unit (21) is arranged on the layer at an equally-spaced angle in a round-down manner in a case where the circumference of the circle is indivisible by the side length of the foldable FSS unit (21).

5. The curved conformal FSS radome according to claim 4, wherein intervals of the foldable FSS units (21) are varied from one layer to the other, and parameters satisfy the following relations:

$$ls = \text{floor}\left(\frac{l}{le}\right)$$

$$rf_1 = r_{13} - \frac{h/1.25}{\tan\theta}$$

$$rf_i = rf_{i-1} + le \times \cos(\theta)$$

$$num_i = \text{floor}\left(\frac{2 \times \pi \times rf_i}{le}\right)$$

in equations, ls being the number of layers of the units that can be arranged on the bus, floor( ) being an rounding function, l being the length of the bus, le being the side length of the foldable FSS unit (21), $rf_1$ being a radius of an outer surface of the dielectric radome (1) where a first layer of foldable FSS units (21) are located from top to bottom, $r_{13}$ being a radius of an inner side of the hollow cylinder (13) of the dielectric radome (1), h being the height of the circular truncated cone (12) of the dielectric radome (1), θ being an included angle between an extension line of the bus and a bottom plane of the hollow cylinder (13), $rf_i$ being a radius of an outer surface of the dielectric radome (1) where an i-th layer of foldable FSS units (21) are located, $rf_{i-1}$ being a radius of an outer surface of the dielectric radome (1) where an (i−1)-th layer of foldable FSS units (21) are located, and $num_i$ being the number of the i-th layer of foldable FSS units (21) arranged along the outer surface of the dielectric radome (1).

6. The curved conformal FSS radome according to claim 5, wherein the curved conformal FSS array (2) has 10 layers, comprising a first layer (201), a second layer (202), a third layer (203), a fourth layer (204), a fifth layer (205), a sixth layer (206), a seventh layer (207), an eighth layer (208), a ninth layer (209) and a tenth layer (210) from top to bottom respectively, 7 units being placed on the first layer (201) with adjacent units being spaced at a central angle of 51.42°, 9 units being placed on the second layer (202) with adjacent units being spaced at a central angle of 40°, 10 units being placed on the third layer (203) with adjacent units being spaced at a central angle of 36°, 12 units being placed on the fourth layer (204) with adjacent units being spaced at a central angle of 30°, 14 units being placed on the fifth layer (205) with adjacent units being spaced at a central angle of 25.71°, 16 units being placed on the sixth layer (206) with adjacent units being spaced at a central angle of 22.5°, 18 units being placed on the seventh layer (207) with adjacent units being spaced at a central angle of 20°, 20 units being placed on the eighth layer (208) with adjacent units being spaced at a central angle of 18°, 21 units being placed on the ninth layer (209) with adjacent units being spaced at a central angle of 17.14°, and 23 units being placed on the tenth layer (210) with adjacent units being spaced at a central angle of 15.65°.

7. The curved conformal FSS radome according to claim 1, wherein an angle of inclination and a length of a bus of the dielectric radome (1) are calculated according to a height of the circular truncated cone (12) and a radius of the hollow cylinder (13), and the number of layers of the foldable FSS units (21) placed on the outer surface of the dielectric radome (1) is further calculated according to a side length of the foldable FSS unit (21).

8. The curved conformal FSS radome according to claim 7, wherein for each layer of foldable FSS units (21), a radius of a circle of an outer surface of the dielectric radome (1) where a center of the foldable FSS unit (21) is located is calculated, to obtain a circumference of the circle of the outer surface of the dielectric radome (1) where the layer of foldable FSS units (21) are located, and the number of the foldable FSS units (21) placed on the layer is further calculated according to the side length of the foldable FSS unit (21) again; and the foldable FSS unit (21) is arranged on the layer at an equally-spaced angle in a round-down manner in a case where the circumference of the circle is indivisible by the side length of the foldable FSS unit (21).

9. The curved conformal FSS radome according to claim 8, wherein intervals of the foldable FSS units (21) are varied from one layer to the other, and parameters satisfy the following relations:

$$ls = \text{floor}\left(\frac{l}{le}\right)$$

$$rf_1 = r_{13} - \frac{h/1.25}{\tan\theta}$$

$$rf_i = rf_{i-1} + le \times \cos(\theta)$$

$$num_i = \text{floor}\left(\frac{2 \times \pi \times rf_i}{le}\right)$$

in equations, ls being the number of layers of the units that can be arranged on the bus, floor( ) being an rounding function, l being the length of the bus, le being the side length of the foldable FSS unit (21), $rf_1$ being a radius of an outer surface of the dielectric radome (1) where a first layer of foldable FSS units (21) are located from top to bottom, $r_{13}$ being a radius of an inner side of the hollow cylinder (13) of the dielectric radome (1), h being the height of the circular truncated cone (12) of the dielectric radome (1), θ being an included angle between an extension line of the bus and a bottom plane of the hollow cylinder (13), $rf_i$ being a radius of an outer surface of the dielectric radome (1) where an i-th layer of foldable FSS units (21) are located, $rf_{i-1}$ being a radius of an outer surface of the dielectric radome (1) where an (i−1)-th layer of foldable FSS units (21) are located, and $num_i$ being the number of the i-th layer of foldable FSS units (21) arranged along the outer surface of the dielectric radome (1).

10. The curved conformal FSS radome according to claim 9, wherein the curved conformal FSS array (2) has 10 layers, comprising a first layer (201), a second layer (202), a third layer (203), a fourth layer (204), a fifth layer (205), a sixth layer (206), a seventh layer (207), an eighth layer (208), a ninth layer (209) and a tenth layer (210) from top to bottom respectively, 7 units being placed on the first layer (201) with adjacent units being spaced at a central angle of 51.42°, 9 units being placed on the second layer (202) with adjacent units being spaced at a central angle of 40°, 10 units being placed on the third layer (203) with adjacent units being spaced at a central angle of 36°, 12 units being placed on the fourth layer (204) with adjacent units being spaced at a central angle of 30°, 14 units being placed on the fifth layer (205) with adjacent units being spaced at a central angle of 25.71°, 16 units being placed on the sixth layer (206) with adjacent units being spaced at a central angle of 22.5°, 18 units being placed on the seventh layer (207) with adjacent units being spaced at a central angle of 20°, 20 units being placed on the eighth layer (208) with adjacent units being spaced at a central angle of 18°, 21 units being placed on the ninth layer (209) with adjacent units being spaced at a central angle of 17.14°, and 23 units being placed on the tenth layer (210) with adjacent units being spaced at a central angle of 15.65°.

* * * * *